US005833537A

United States Patent [19]

Barrie

[11] Patent Number: 5,833,537

[45] Date of Patent: Nov. 10, 1998

[54] GAMING APPARATUS AND METHOD WITH PERSISTENCE EFFECT

[75] Inventor: Robert Barrie, Merrimack, N.H.

[73] Assignee: Forever Endeavor Software, Inc., Merrimack, N.H.

[21] Appl. No.: 723,322

[22] Filed: Sep. 30, 1996

[51] Int. Cl.[6] ..... G07F 17/34; A63F 9/22

[52] U.S. Cl. ..... 463/21

[58] Field of Search ..... 463/16, 17, 18, 463/19, 20, 21

[56] References Cited

U.S. PATENT DOCUMENTS

| | | | |
|---|---|---|---|
| 3,580,581 | 5/1971 | Raven | 463/21 X |
| 4,621,814 | 11/1986 | Stephan et al. | 273/138 A |
| 4,837,728 | 6/1989 | Barrie et al. | 364/412 |
| 5,326,104 | 7/1994 | Pease et al. | 273/138 A |
| 5,580,309 | 12/1996 | Piechowiak et al. | 463/20 X |
| 5,647,798 | 7/1997 | Falciglia | 463/19 |

FOREIGN PATENT DOCUMENTS

| | | |
|---|---|---|
| 48825/85 | 5/1986 | Australia . |
| 2111317 | 7/1994 | Canada . |
| 2 144 644 | 3/1985 | United Kingdom . |
| 2 147 773 | 5/1985 | United Kingdom . |
| 2 148 135 | 5/1985 | United Kingdom . |

*Primary Examiner*—William H. Grieb
*Attorney, Agent, or Firm*—Sheridan Ross

[57] ABSTRACT

An electronic gaming device and method is provided in which redefined events result in positioning symbols on a playing field which persist in their location and effect through two or more sequential rounds of a game. Preferably, the symbols can affect the amount of a pay out, although preferably they do not affect whether or not a game has a winning result. Persistent symbols may be removed in response to various events, such as occurrence of a delete symbol, passage of time or playing of a predetermined number of rounds.

11 Claims, 11 Drawing Sheets

GAMING APPARATUS AND METHOD WITH PERSISTENCE EFFECT

The present invention relates to a gaming apparatus and method in which an indicator persists between successive rounds of games and, preferably, in which the indicator can affect the reward for a winning game outcome.

BACKGROUND INFORMATION

A number of electronic gaming devices, including those commonly found in gaming casinos, include a visual display which shows a number of gaming indicia or symbols (i.e., indicia or symbols which are used in playing the game). In previous devices, each of these symbols or indicia typically has the potential to change from one round of a game to the next. For example, in a simulated slot machine, the symbols that are displayed to simulate the symbols that appear when slot machine reels have stopped are gaming symbols and have the potential to change with each handle pull or other play of the slot machine. In a keno game, positions corresponding to numbers 1–80 may have indicia indicating which of up to 20 numbers have been selected by the game, and, again, these symbols may change from one round or play to the next.

In some situations, it is desirable to provide a gaming environment in which players are motivated to play multiple rounds of a game. What constitutes a "round" of a game varies from game to game, but is generally initiated by a user providing input that signals the user's desire or commitment to playing the round, such as pulling a handle, pushing a button and the like, often accompanied by placing of a wager. Typically, payment of a monetary prize or the awarding points is done only in response to the playing of a round of a game. For example, a round of a reel slot machine game (often referred to as a "spin") typically involves pulling the slot machine handle and waiting for the reels to stop spinning. A round of a video poker game typically involves pushing a button to receive a simulated deal, selecting discard cards and receiving simulated cards as a replacement for those discarded. A round of a blackjack game involves receiving an initial deal and requesting additional cards as desired. A round of a Keno game involves selecting a set of numbers and waiting for display of which numbers were chosen by the game.

It is believed an environment which encourages play of multiple rounds of a game would add to the player's interest in a particular game, thus increasing entertainment value, and may also increase the number of rounds played by the player, potentially increasing revenue to the casino or other game operator. However, previous gaming environments which provide for a playing field in which symbols can always change from round to round (i.e. in which the symbols displayed on a gaming field are always independent of one another) has provided little opportunity to encourage players to play multiple rounds of a game. Some game have been configured to provide two or more modes such as a normal mode and a so-called frenzy mode, with the frenzy mode providing increased prizes or increased likelihood of winning. One draw-back of a frenzy or multi-mode game is that, once the frenzy mode is completed, users may feel that the "investment" in achieving the frenzy mode has been spent and may be discouraged from playing subsequent rounds of the game since a relatively large number of non-frenzy mode rounds must be "invested" before the benefit of the frenzy mode can be achieved. Additionally, by defining two distinct modes of play, the game lacks a desirable integrated feel.

Accordingly, it would be useful to provide a gaming apparatus and method which is not limited to a playing field in which all reward-affecting symbols can always change from one round of a game to the next.

SUMMARY OF THE INVENTION

According to the present invention, a gaming apparatus and method is provided which includes indicators or symbols which are positioned on the playing field of the game, such as in response to a game event or other event, and which persist from one round of a game to a subsequent round or rounds of the game. Preferably, the persistent symbol or indicator affects the amount of prize or award, for at least some winning game outcomes. For example, in an electronic slot machine, the device can be configured such that the reward for a winning pay line is multiplied when one or more persistent symbols or indicators are positioned along the winning pay line. In one embodiment, the persistent symbols may include or be integrated with a form of animation to further add to the entertainment value of the game.

In one embodiment, an electronic gaming device and method is provided in which predefined events result in positioning symbols on a playing field which persist in their location and effect through two or more sequential rounds of a game. Preferably, the symbols can affect the amount of a pay out, although preferably they do not affect whether or not a game has a winning result. Persistent symbols may be removed in response to various events, such as recurrence of a deleting symbol or passage of time or playing of a predetermined number of rounds of the game.

DETAILED DESCRIPTION OF THE PREFERRED EMBODIMENTS

Figure 1:
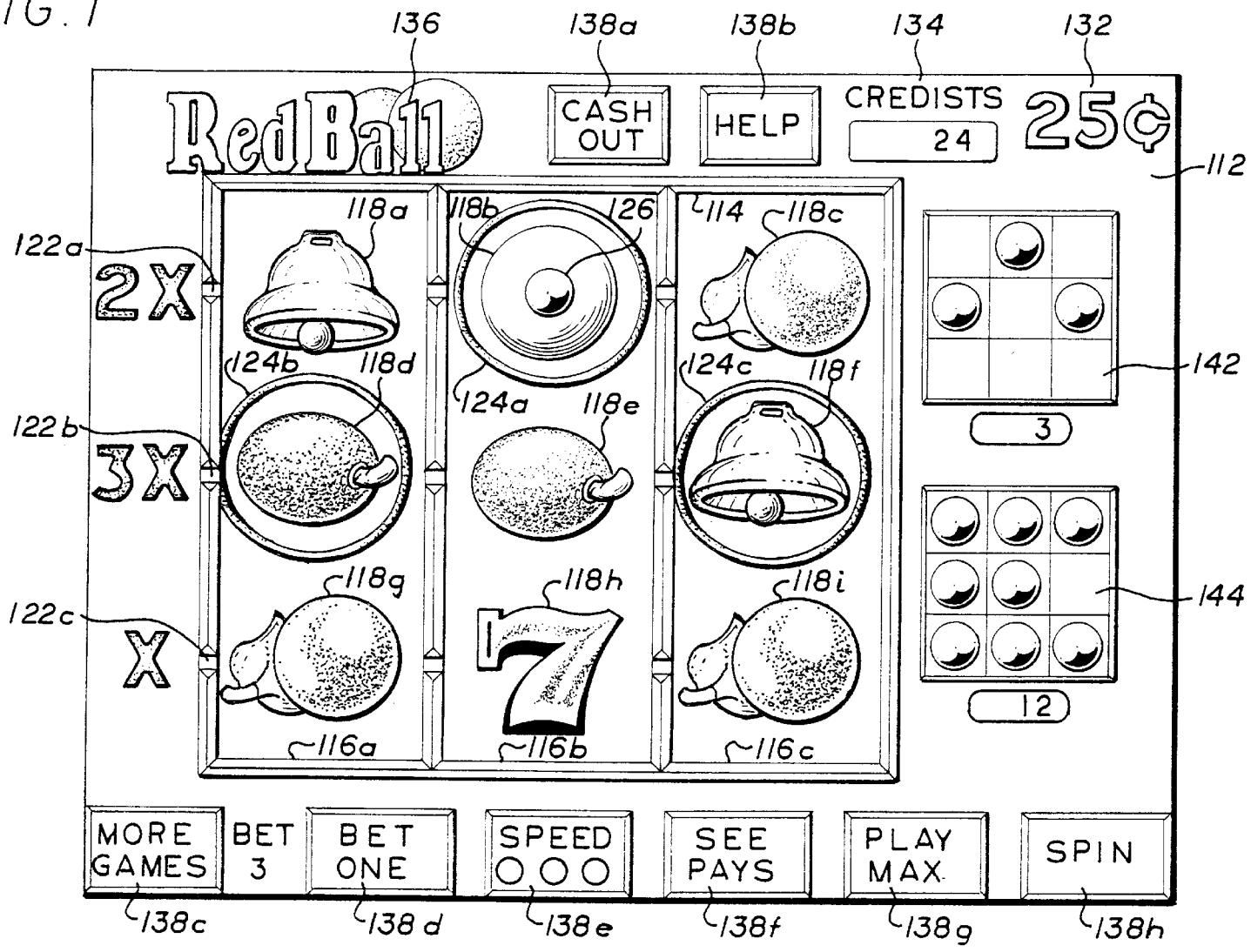
FIGS. 1 and 1A are elevational views of the appearance of display screens according to embodiments of the present invention.

As depicted in FIG. 1, the present invention can be implemented in a fashion which retains many of the features of present electronic gaming terminals. For example, in the embodiment depicted in FIG. 1, the display screen 112 includes a playing field 114. The playing field is the region of the display which shows the symbols involved in playing the game. Thus, in the depicted simulated slot machine, the playing field shows the simulated slot machine wheels. In a keno game, the playing field shows a simulated keno card. In a video poker game, the playing field shows an image of simulated cards which have been dealt. The display 112 may also include other indicia, indicators, or touch screen regions such as a denomination indicator 132, a credit indicator 134, a game indicator or logo 136, and various touch screen regions or "soft buttons" 138*a* through 138*h*, for use in playing the game. It is also possible to use other input devices for playing the game such as a button panel, keyboard, mouse, joystick, and the like.

In the embodiment of FIG. 1, the playing field depicts a simulation of the exposed portion of three reels 116*a*, 116*b*, 116*c* of the slot machine. In the depicted embodiment, nine symbol positions are provided 118*a* through 118*i*. Other electronic slot machines may provide more or fewer reels and more or fewer exposed symbols per reel. In the depicted embodiment, three horizontal pay lines are defined 122*a*, 122*b*, 122*c*. In a typical game, there is a winning outcome if any of a number of predetermined winning symbol combinations (e.g., three sevens, three oranges, etc.) appear along any of the pay lines. Electronic slot machines can be provided with more or fewer pay lines and/or pay lines which are non-horizontal (such as diagonal). In the embodiment depicted in FIG. 1, the game field 114 includes traditional symbols associated with the game such as a bell 118*a*, a plum 188*d*, an orange 118*g*, and so forth. The symbol appearing in the various locations of the game field has the potential to change in each round of the game (or "spin"). Of course, it is possible that when the next round of the game is played, the random stop positions for the simulated slot machine reels will result in a bell being, once again, positioned in the upper left play field position 118*a*. However, the game is not configured to purposely reposition this game symbol in this position through successive rounds or plays.

According to the present invention, portions of the game field 114 or other areas, such as pay lines or pay line indicators, can also be occupied by symbols 124*a*, 124*b*, 124*c*, which are configured to be persistent between successive rounds of the game. In the embodiment of FIG. 1, the symbols are configured as rings 124*a*, 124*b*, 124*c*, although other symbols could also be provided as persistent indicators. As seen in FIG. 1, the persistent symbols may occur in a game field position at the same time that a traditional symbol appears at that position (such as ring 124*b* and plumb 118*d*). Preferably, a persistent indicator is initially provided in response to an event. In the depicted embodiment, the initial placement of a persistent indicator 124*a* at a given location is the result of the appearance, at that location, of a particular gaming symbol, in this case, a "red ball" symbol 126 in one of the play positions 118*b*. Thus, in this embodiment, whenever a simulated slot machine reel (or virtual reel) stops in a position such that a red ball symbol appears at a position of the game field 114, that position 118*b* is also occupied or indicated by a persistent symbol 124*a*. In this embodiment, an event that results in a persistent symbol can occur in any round of a game, even immediately after a user has received an enhanced prize as a result of the presence of a previous persistence symbol. Once a persistent symbol 124*a* is positioned in this fashion, the persistent symbol 124*a* will remain on the play field, and preferably in that position of the play field, at least through one and (depending on the configuration of the game), potentially through many, successive rounds or plays of the game, even though the other gaming symbols occupying that position in successive plays will typically be symbols other than a red ball symbol. Thus, in the embodiment of FIG. 1, the red ball symbol has landed on positions 118*d* and 118*f* during previous rounds of the game (previous slot machine handle pulls) and the corresponding persistent symbols 124*b*, 124*c* have persisted to the game field configuration shown in FIG. 1, even though the symbols located in positions 118*d* and 118*f* are currently symbols other than the red ball symbol.

Preferably, although the persistent symbols 124*a*, 124*b*, 124*c* last through two or more successive rounds or spins, there is also a mechanism for deleting or removing the persistent symbols 124*a*, 124*b*, 124*c*, at some point. In one embodiment, another symbol (e.g., a "black ball") symbol, is defined such that, if the black ball symbol lands in a position bearing a persistent symbol, the persistent symbol will be removed from that position. Thus, if, in the next spin, the black ball symbol lands at position 118*d*, the persistent symbol 124*b* will be removed, although the other persistent symbols 124*a*, 124*c* will not necessarily be removed. In another embodiment, a persistent symbol is removed if its position is occupied by another occurrence of the symbol that initiated its presence (the "red ball" symbol is the example of FIG. 1).

Preferably, the presence of one or more persistent symbols can affect game play such as by affecting the amount of pay out. In one example, a pay line 122 which has a single persistent symbol in a position of the pay line will have the normal pay out for a winning outcome on that pay line multiplied by two if there is a winning combination on that pay line, a pay line having two persistent symbols will have the normal payoff multiplied by three if there is a winning combination on that pay line, and a pay line which has three persistent symbols will have the normal payout multiplied by five if there is a winning combination on that pay line. If desired, the display 112 may be configured to indicate the current multiplier value for the pay line, as shown on FIG. 1.

Figure 1A:
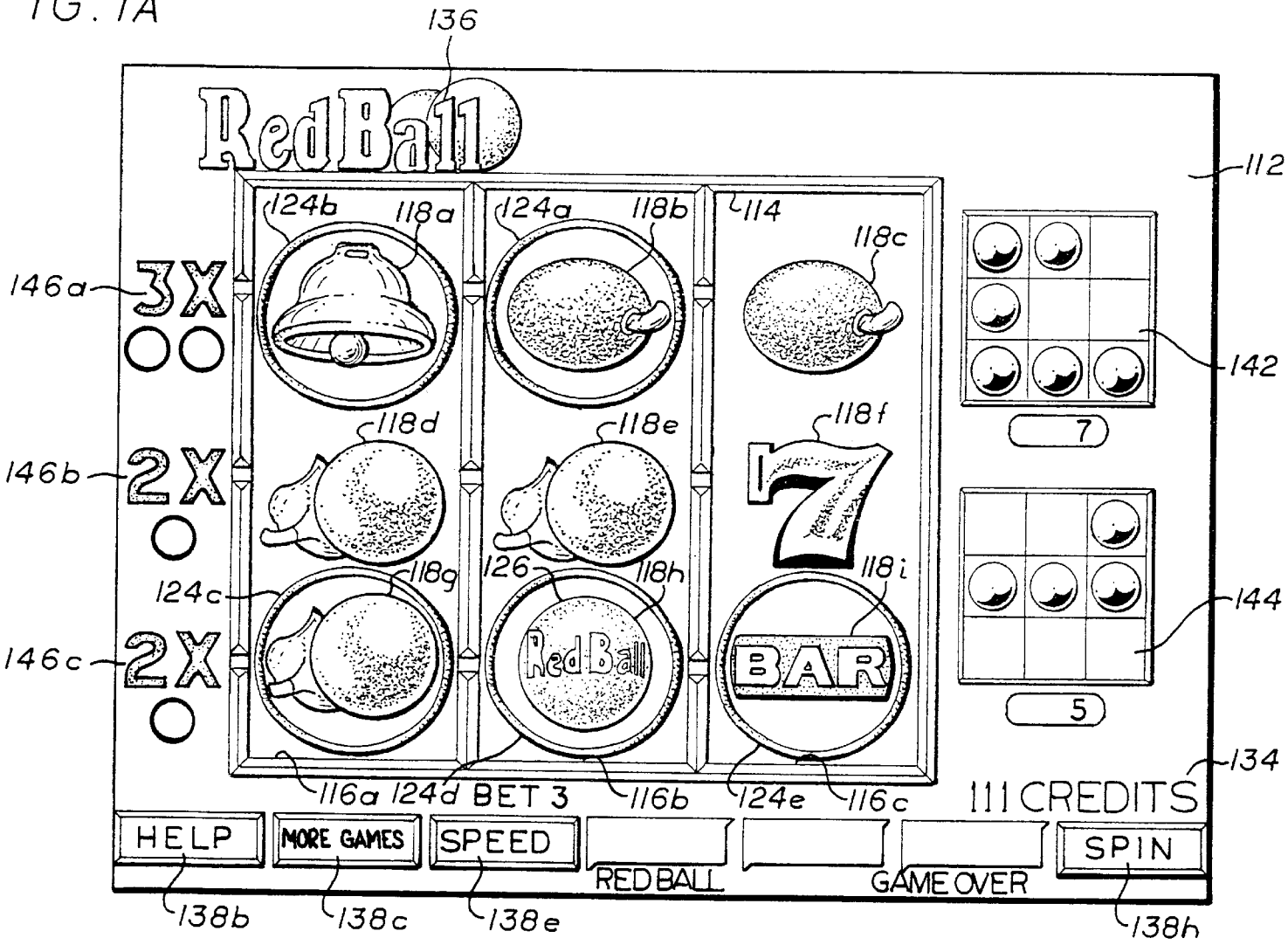

FIG. 1A depicts another embodiment of the present invention. The embodiment of FIG. 1A is similar to that of FIG. 1 but certain buttons or other controls are in different locations 138 and additional symbols are provided for showing line award multipliers 146*a–c*.

Figure 2:
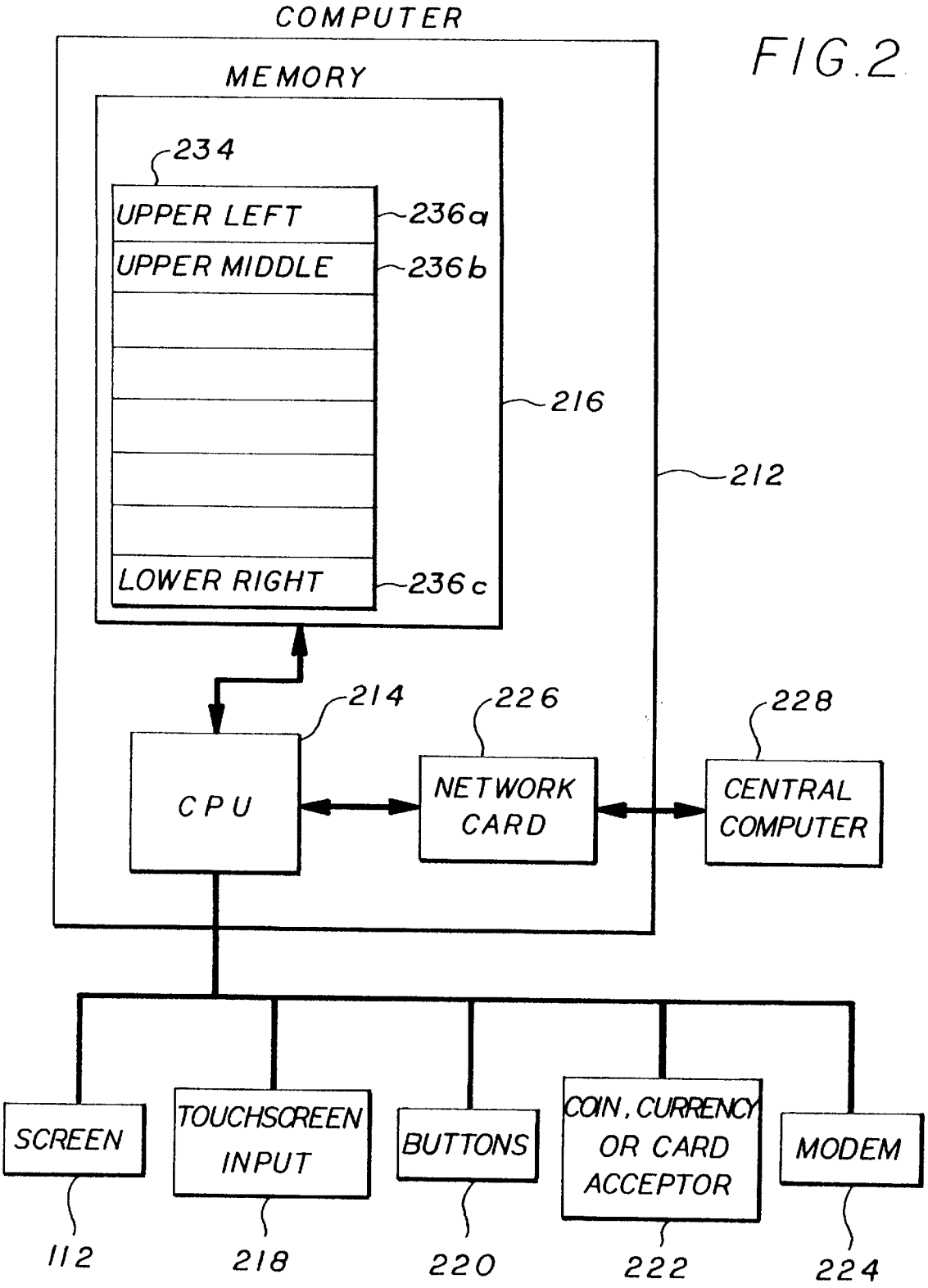
FIG. 2 is a block diagram depicting a processor-based device for use in connection with an embodiment of the present invention.

The present invention can be implemented using a variety of different apparatus. Preferably, the invention is implemented using a computer to determine game operation and control the display 212. However, it is also possible to provide the logic needed for implementing the invention in an application specific integrated circuit (ASIC) or other hardware device. In the embodiment of FIG. 2, the computer 212 includes a central processing unit (CPU) 214 coupled to a memory 216. The computer 212 may also be coupled to other peripheral devices such as a touch screen input device 218, one or more buttons 220, for use in playing the game, a coin, currency or card acceptor 222, e.g., for allowing the user to place wagers, a modem 224, and/or network card 226, e.g., for communicating with a central computer 228. The central computer 228 may be used for accounting, bookkeeping, and/or security purposes, or for downloading software or other upgrades or for controlling the operation of the game (e.g., for playing a game over a network or a group of networks such as the Internet). The persistence aspect of the present invention could be implemented in a number of fashions. In the depicted embodiment, the memory includes an array 234 having memory locations 236*a*, 236*b*, 236*c*, associated with each of the play position 188*a* through 118*i* of the play field 114. In this embodiment, the memory 216 can be used to indicate that a persistent symbol 124 should be displayed at a position of the play field 114 by storing a predetermined value or values in the corresponding memory location 236*a* through 236*i*. In one embodiment, the value stored may be a logical true/false value. In another embodiment, however, it may be desired to include an indication of the age of a persistent symbol. For example, it may be desired to remove a persistent symbol after it has remained in place for a predetermined number of rounds of the game. In an embodiment in which it is desired to retain a persistent position for no more than five successive rounds, the system can be configured such that a value of zero in a memory location means that no persistent symbol is to be displayed in the corresponding play field position, and such that a value of five is stored in the corresponding memory location whenever a persistent symbol is first positioned at a location of the play field. Thereafter, each time a round is played, the values of all non-zero, positive memory locations in the array 234 may be decremented by one. In this fashion, a persistent symbol will be removed after five games. If desired, the display 112 may be configured to include an indication of the age of a persistent symbol, such as by initially showing a persistent symbol in a vivid color or contrast and successively diminishing or fading the color or contrast of the persistent symbol for each successive round until it finally disappears or is removed. It is believed that symbol animation of this type may contribute to interest in the game and thus increase the level of enjoyment, as well as the tendency to play multiple rounds.

Figure 3:
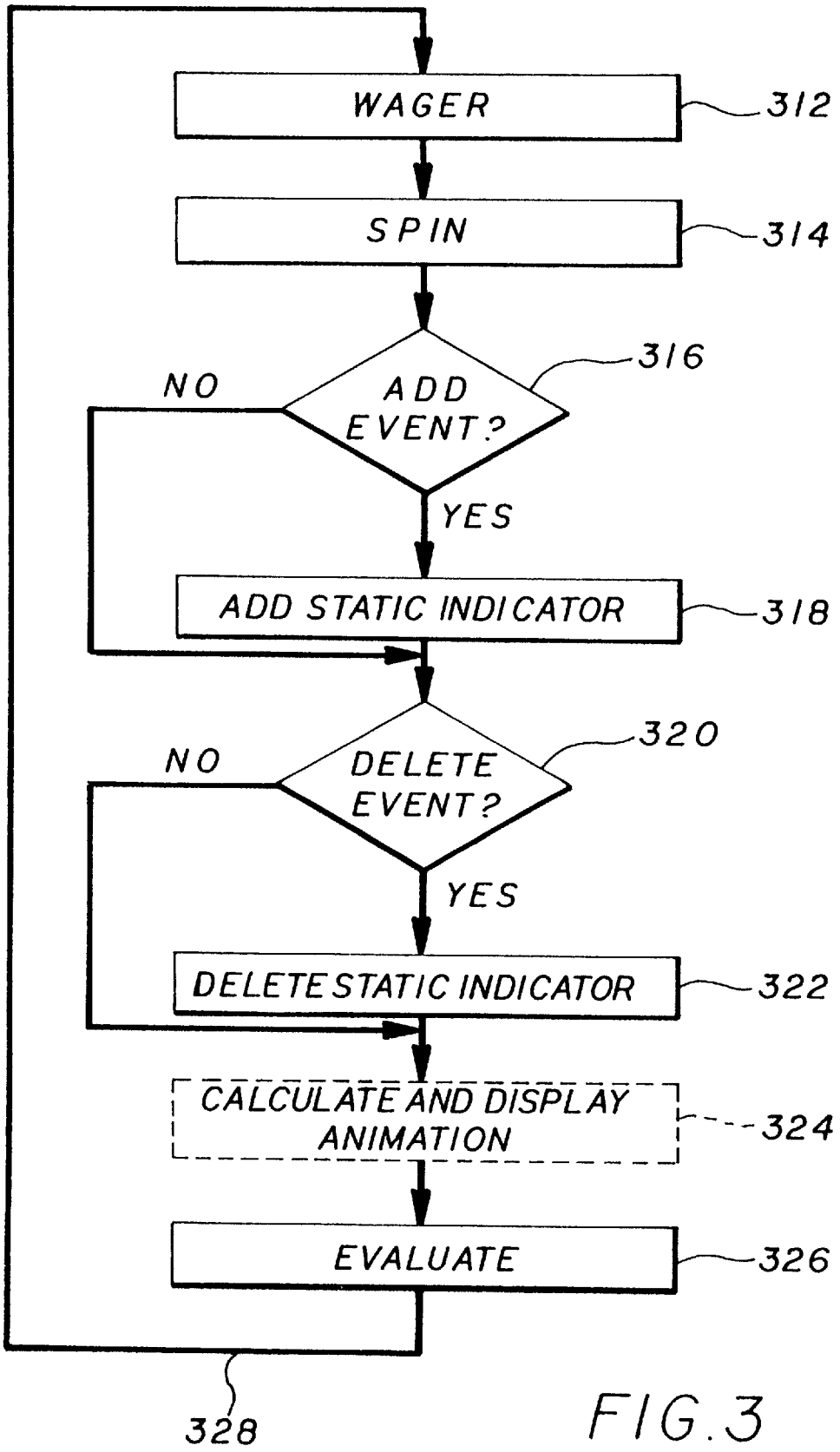
FIG. 3 is a flow chart depicting a procedure for playing a game with a persistent symbol according to an embodiment of the present invention.

As depicted in FIG. 3, the game is initiated when a player places a wager 312 and initiates a spin 314 (or, in the case of keno game, a number draw; in the case of a card game, a deal, etc.). After the spin, it is determined whether an add event has occurred 316. In the embodiment of FIG. 1, an add event is the appearance of a red ball. A number of types of add events can be used for the present invention. For example, a persistent symbol can be added in response to the passage of a certain amount of time or play of a certain number of rounds, without the appearance of the persistent symbol in a given position. Persistent symbols can be randomly generated, e.g., by events output from a random number generator, and the like. If an add event has occurred, the persistent indicator is shown on the play field 318. The system also determines whether a delete event has occurred 320. In the embodiment of FIG. 1, a delete event is the appearance of a black ball in a location which bears a persistent symbol. Other types of delete events can be used, such as the passage of a certain amount of time or play of a certain number of games, a period of time without any game play, a new player initiating play on the gaming terminal (as might be indicated by a player card inserted in the card acceptor), and the like. If desired, the frequency of adding and/or deleting events may be dynamic, such as changing the frequency at various times of day, or in other fashions, e.g., for marketing purposes and the like.

If a delete indicator appears at a location occupied by a persistent symbol, the corresponding persistent symbol is deleted 322. In cases where animation is desired, an animation routine may be displayed 324, such as in connection with the appearance or disappearance of a persistent symbol, adjustment of the display prize amounts, and the like. The animation may be accompanied by appropriate sound effects or other audio signals, if desired. Once the appropriate changes to persistent symbols have been made, the game outcome is evaluated 326 so that pay outs for any winning combinations or other game outcomes can be made. Thereupon, the system returns 328 to permit the player to place another wager and play another round.

Figure 4:
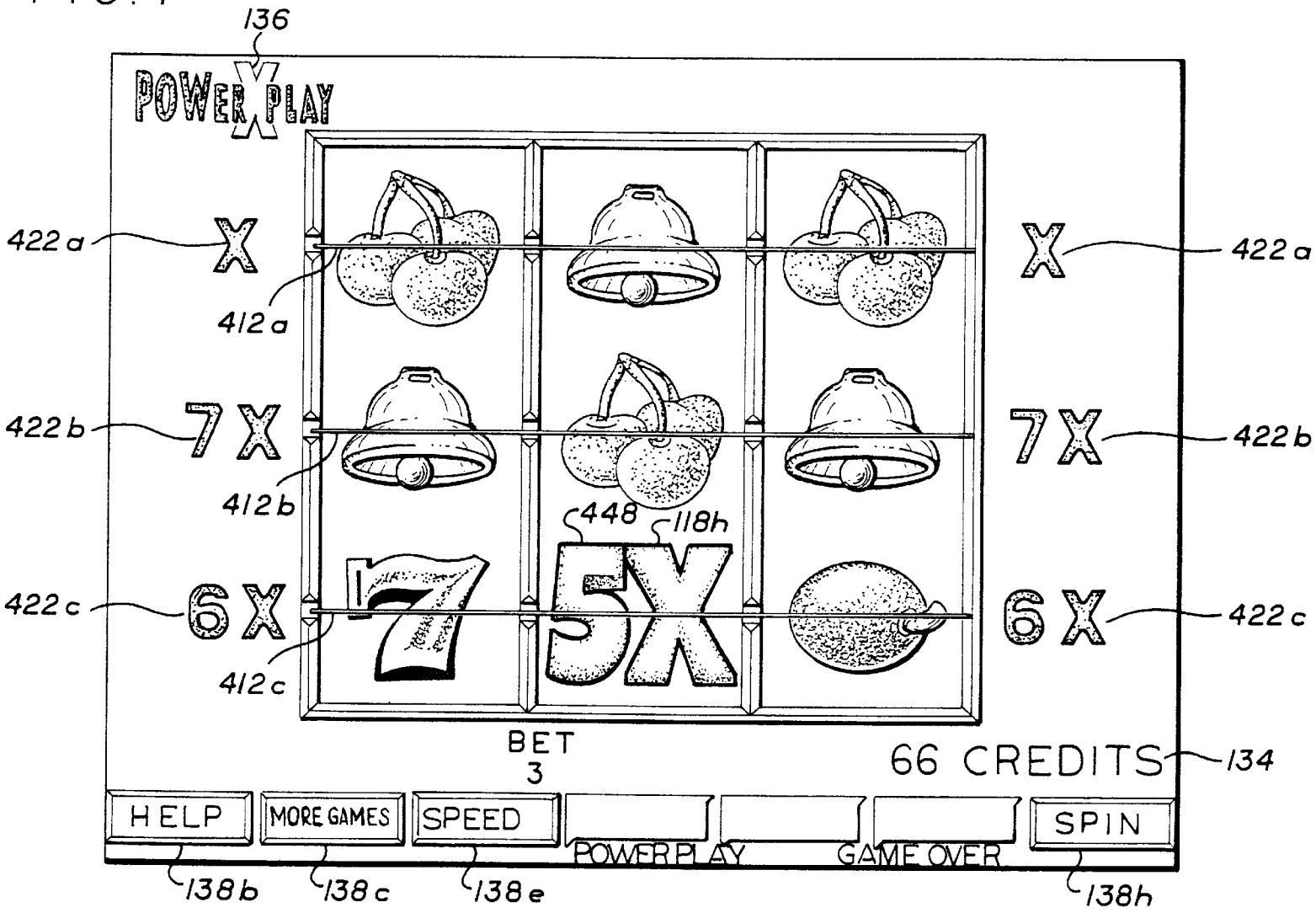
FIG. 4 is a view similar to the view of FIG. 1, but showing another embodiment of the present invention.

FIG. 4 depicts an embodiment similar to that of FIG. 1, but in which pay line multiplier indicia 422*a, b, c* are used as persistence symbols. In the embodiment of FIG. 4, one event which causes the appearance, or a change in the appearance, of the persistence symbols 422*a,b,c* is the occurrence of a multiplier symbol 448 in one of the reel positions 118*h*. When such a symbol 448 occurs, the multiplier in the payline which contains this position 118*h* (in this example, the bottom payline 412*c*, is changed to show a new value. In one embodiment, the new value will be the sum of the previous value and the value of the multiplier symbol 448. For example, if, prior to the spin whose result is depicted in FIG. 4, the bottom line had a multiplier value of 1 (indicated by "x", as shown 422*a* for the top payline 412*a* of FIG. 4), after the appearance of the "5x" symbol 448, the new multiplier value will be the sum of the old value (x) and the new value (5x), i.e. x+5x or 6x, as shown 422*c*. In one embodiment the display is controlled to provide animation in connection with the change in the payline multiplier symbol. For example, in one embodiment, when the 5x symbol 448 lands on a reel position 118*h*, it appears to split into two copies of the 5x symbol which travel laterally to a position over the existing left and right payline multiplier symbol positions before being replaced by the new left and right payline multiplier symbols 422*c*, 422*c'*.

Figure 5:
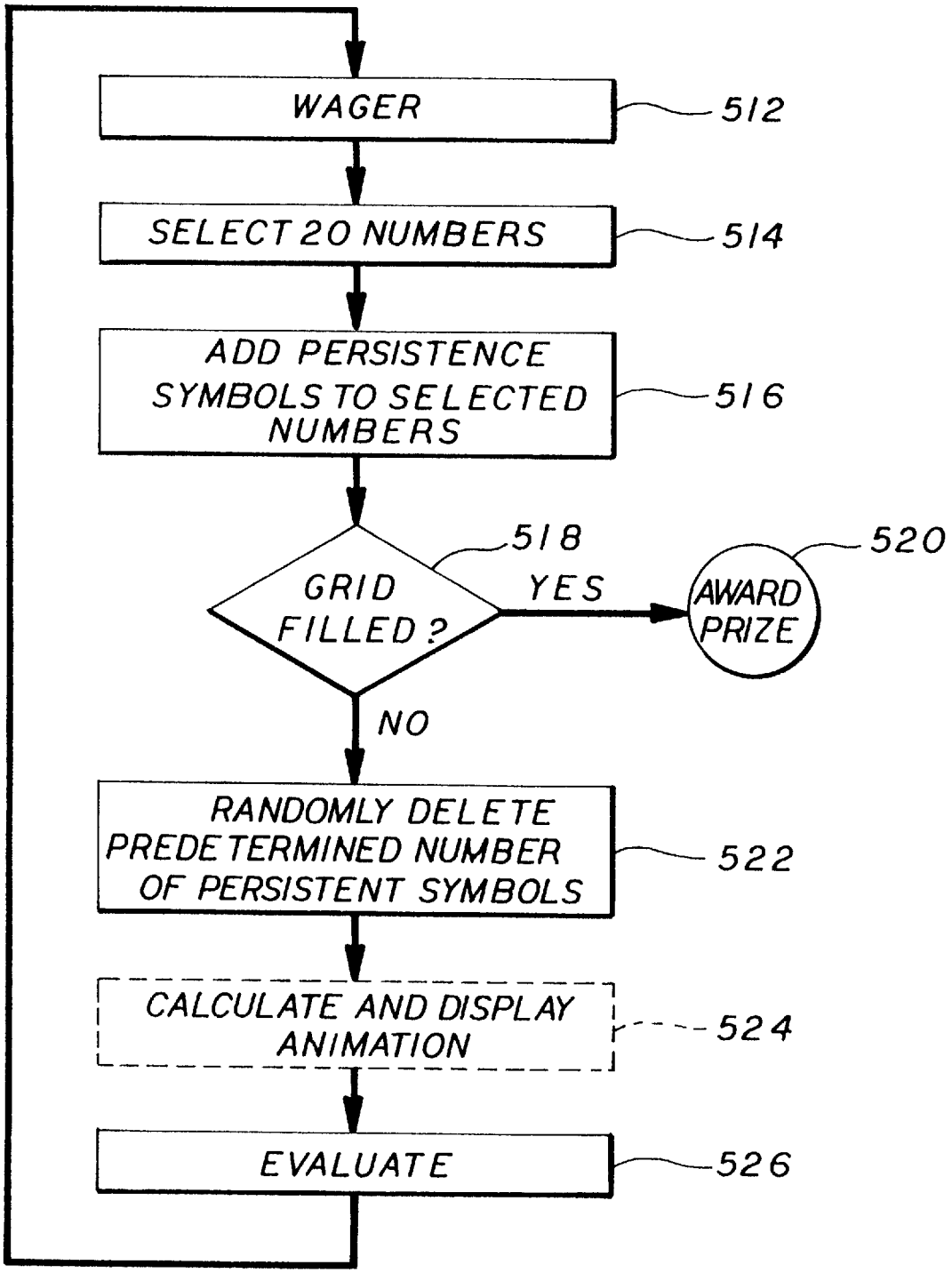
FIG. 5 is a flow-chart of a procedure for playing a game according to an embodiment of the present invention.
Figure 6:
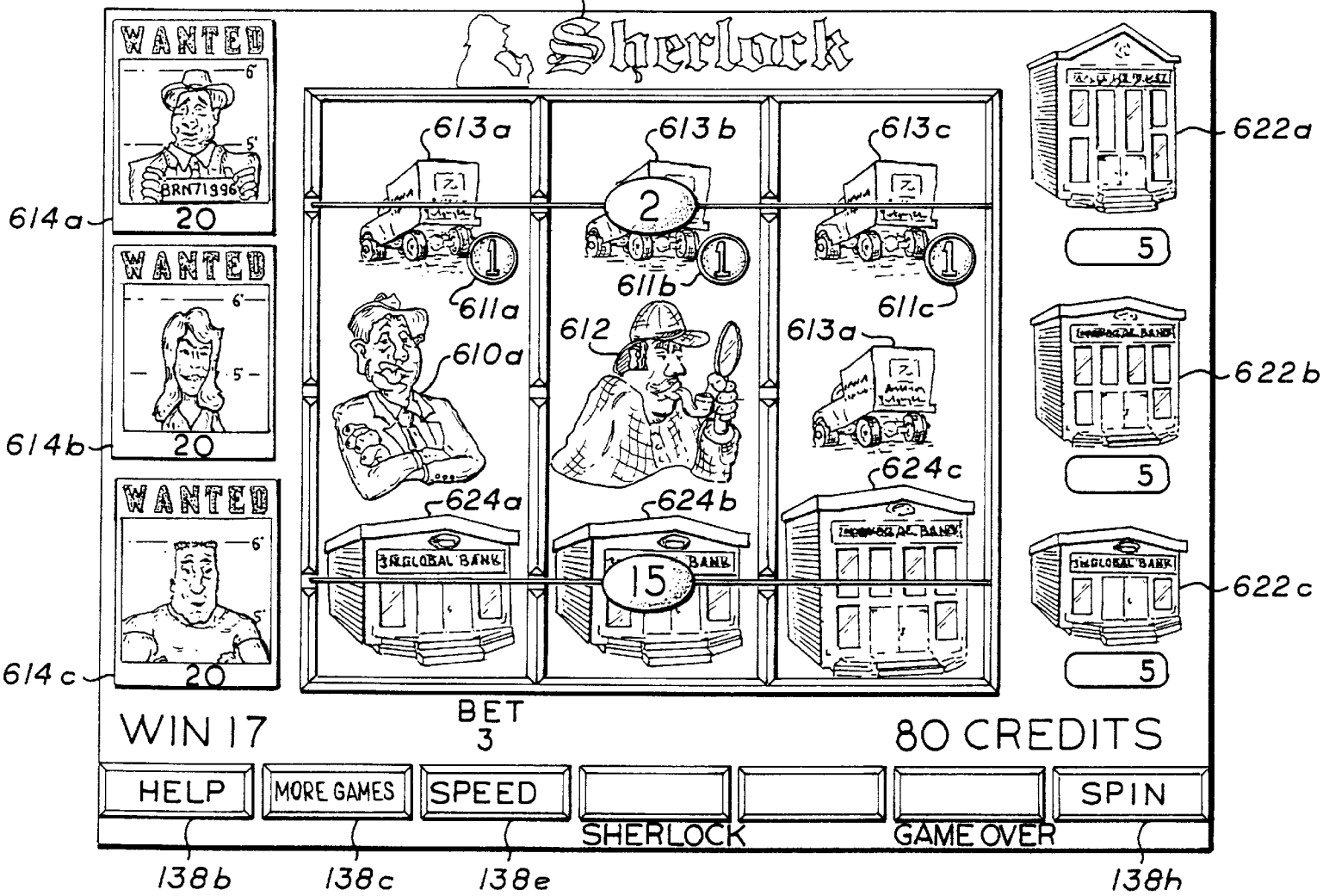
FIG. 6 is a view similar to the view of FIG. 1, but showing another embodiment of the present invention.

Although FIGS. 1, 4, 6, 7, 8A and 8B depict embodiments of the present invention, which employ an electronic slot machine paradigm, other types of games can be used in connection with the present invention. FIG. 5 depicts a procedure which may be used in connection with an electronic keno game. In the embodiment of FIG. 5, after the user places a wager 512, the game selects up to 20 numbers, e.g., of a total of 80 potential numbers 514. In the embodiment of FIG. 5, a persistent symbol such as a check mark is positioned in each number location selected by the user in the previous step 516. The system then determines whether a minimum number, such as all of the symbol positions on the simulated keno card, have been filled with check marks 518, and, if so, a special prize 520, based on the presence of the persistent symbols is ordered. Otherwise, the system randomly deletes a number of the persistent symbols 522. In one embodiment, the number which is deleted on each turn is a constant. In another embodiment, the deleted number may vary from round to round. Preferably, the number deleted is, at least on average, low enough to permit a determined player to eventually win the prize 520, but large enough to require players, in most cases, to play a relatively large number of rounds in order to have a reasonable chance of winning the prize 520. In one embodiment, two to three symbols are deleted each round. As before, the device may be provided with animation 524, in conjunction with the persistence features of the game.

In some embodiments, the game may be provided with a theme or plot, preferably in conjunction with game animation. For example, in the embodiment of FIG. 6, a crime-theme game is provided in which the persistent symbols may be given the appearance of a coin 611*a,b,c.*, the events which cause the persistent symbol to appear may be the appearance on the playing field of an armored car 613*a,b,c*. If desired, the coin image may fade throughout successive rounds of the game until it has faded completely and is removed from the game. In one embodiment, if a "crook" symbol 610*a* lands on a position which has a persistent symbol that has not yet completely faded, the payline prize amount (having the form of a "wanted" poster 614*a,b,c* in the depicted embodiment) is incremented, preferably by an amount related to the denomination of the depicted coin 611. If a "detective" symbol 612 lands on a coin-bearing position before the coin has completely faded the player receives an immediate prize, preferably a monetary award related to the denomination of the depicted coin. In one embodiment, a second game, such as a progressive game, is displayed on the screen, in this case associated with bank indicia 622*a, b,c*. If a bank symbol 624*a,b,c* lands on a reel position bearing a persistent coin symbol 611, the prize or point value associated with progressive game bank symbol 622 aligned with the payline where the bank symbol 624 landed is incremented. If desired, incrementation of values associated with wanted posters 614 and/or banks 622 may be animated, such as by depicting an image of a coin traveling from a reel position to a wanted poster 614 or bank 622 image.

Figure 7:
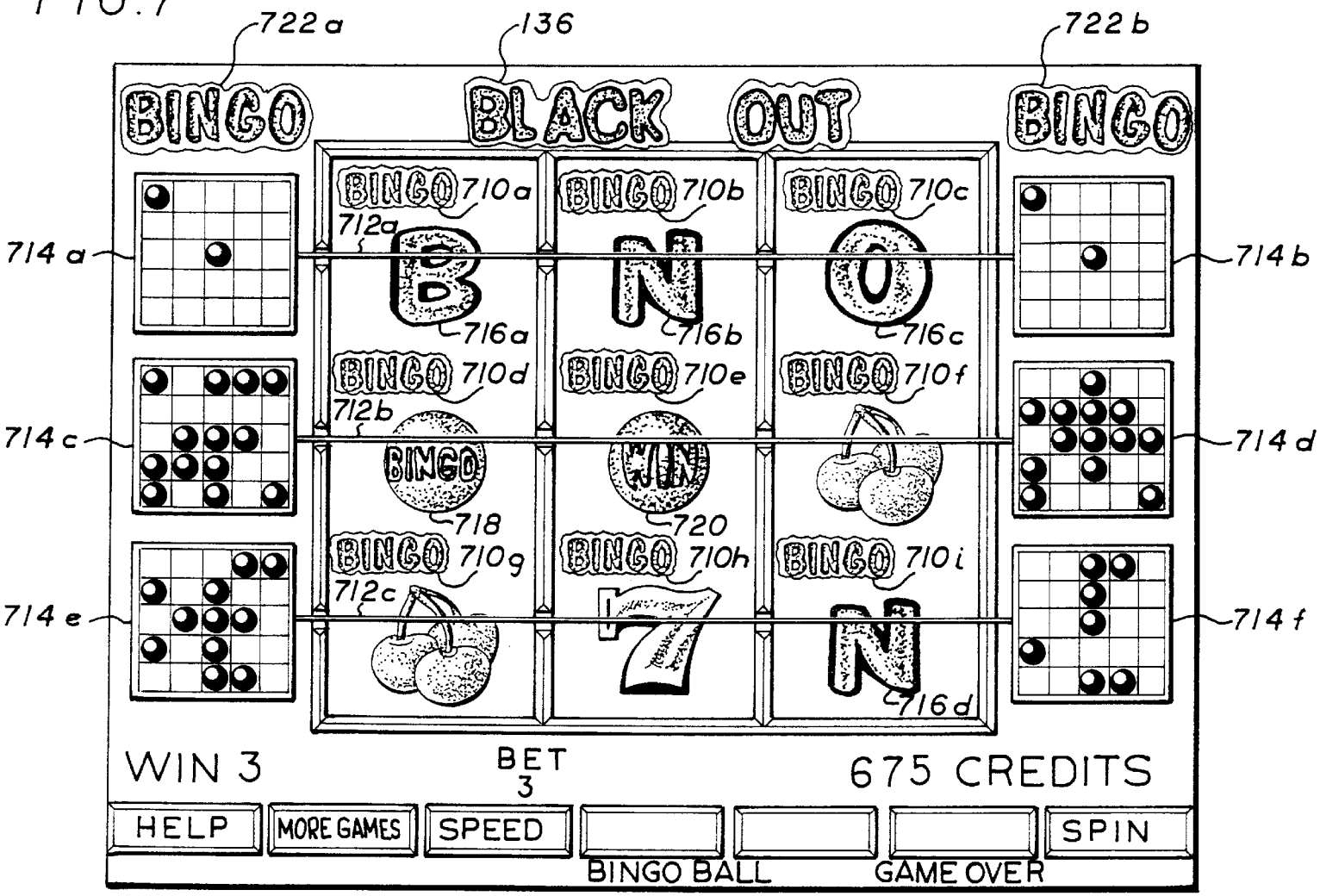
FIGS. 7 and 7A are views similar to the view of FIG. 1, but showing other embodiments of the present invention.

FIG. 7 depicts an embodiment which provides for persistence in the form of highlighting. Thus, in the embodiment of FIG. 7, each of the simulated slot machine reel positions is occupied by the word "bingo" 710*a*–710*i*. However, only those letters of those words which are highlighted (such as the "b" and "i" in the upper left corner 710*a*) affect game outcome or prizes, as described more thoroughly below. In the depicted embodiment, there are three pay lines 712*a*, 712*b*, 712*c*. Associated with each pay line is a simulated bingo card 714*a*–714*f*. In one embodiment, the number of coins wagered determines how many of the cards 714 are rendered active (so that the persistence symbols can affect placement of markers on the cards, as described below). In the depicted embodiment, the various reel symbols that can be displayed include, among other symbols, the letters of "bingo" 716*a*–716*d*, a bingo ball 718 and a win ball 720. When one of the bingo letters 716*a*–716*d* lands on one of the reel stop positions, highlighting of a corresponding letter in the associated bingo word 710 is toggled (turned off if previously on and turned on if previously off). Thus, in the depicted configuration, because "n" has landed on the lower right position 716*d* and because the letter "n" in the corresponding bingo symbol 710*i* was not previously highlighted, the "n" in the bingo symbol 710*i* will become highlighted. As in other examples, the present embodiment provides for both a persistence feature and a multitude of single games. In the depicted embodiment, single games operate as a normal slot machine game in which a normal payout is provided (e.g., depending upon a stored pay table) in response to predetermined symbol combinations (such as three oranges, three cherries, three like letters, any three letters, three win balls, three bingo balls or any three balls on a pay line). The persistence feature operates in conjunction with a bingo card 714. According to the depicted embodiment, each simulated bingo card has five columns, each column corresponding to one of the letters of "bingo" 722*a*, 722*b*. Preferably, one or more predetermined events in the regular game (such as the occurrence of a three ball combination on a pay line) results in markers being placed on those cards corresponding to that pay line (if activated) for each letter of the bingo symbols 710 of that pay line which are highlighted. For example, if, on the next spin, the top pay line 712*a* had a three ball combination and highlighting of the corresponding bingo symbol 710*a*, 710*b*, 710*c* was as shown in FIG. 7, the two bingo cards 714*a*, 714*b* corresponding to the top pay line 712*a* would each receive two additional markers in the "b" columns of the card, two additional markers in the "i" columns of the card, and one marker in each of the "g" and "o" columns of the card.

Figure 7A:
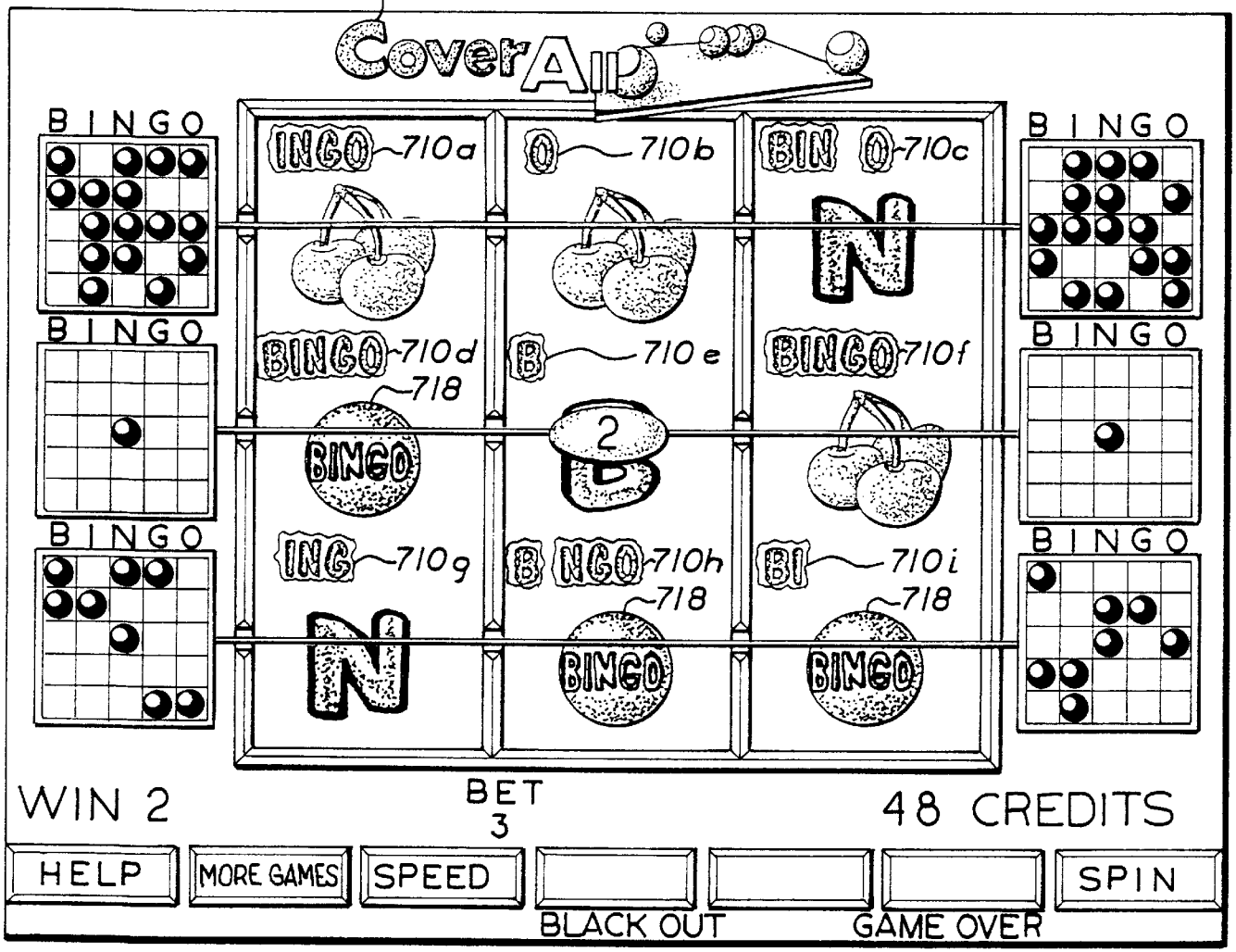

FIG. 7A depicts the appearance of a screen for use in another embodiment, which is similar to the embodiment of FIG. 7, but in which the bingo symbols 710*a'*–710*i'* include only the letters which are currently active for that reel position (rather than showing all letters and highlighting only the active letters, as in FIG. 7).

Various schemes can be provided for awarding prizes based on the markers on the bingo cards 714. In one embodiment, the game pays various amounts for blackout (all positions of a card bearing markers), four corners, outer ring, X, any diagonal or any row. Although it is possible to use combinatoric/statistical analysis to determine the game parameters, it may be more straightforward to simulate a large number of games at different pay amounts (and/or other game parameters) in order to fine-tune the percentages to achieve the desired game operation.

Figure 8A:
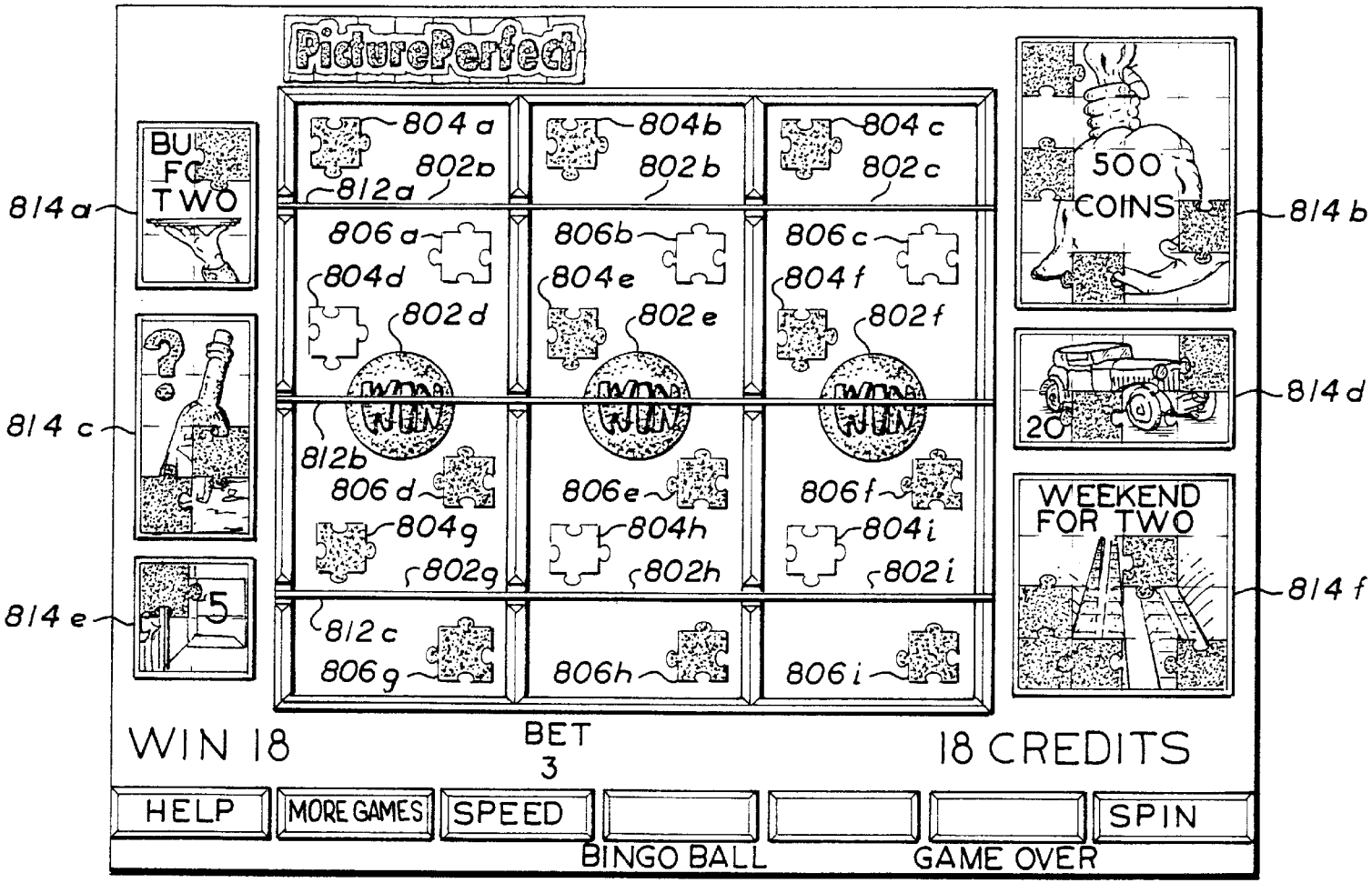
FIGS. 8A and 8B are views similar to the view of FIG. 1, but showing other embodiments of the present invention.

Another example of a persistence feature is depicted in FIG. 8A. This game has some features similar to the game of FIG. 7 in that payout is provided when all positions of the corresponding side displays (in this case, configured to resemble a jigsaw puzzle) are filled. In the depicted embodiment, the simulated slot machine has nine reel positions 802*a*–802*i*. Associated with each reel stop position are first (804*a*–804*i*) and second (806*a*–806*i*) puzzle piece symbols. Each of these symbols may be either highlighted (e.g., 804*a*) or unhighlighted (e.g., 806*a*). In one embodiment, the shapes of the various puzzle pieces 804, 806 symbols may be randomly selected (such that only those puzzles pieces that are won and which correspond to a missing piece for a corresponding puzzle, are added to the puzzles 814*a*–814*f*). If desired, the various puzzle piece shapes may be positioned randomly, either with even weighting to all pieces or with different parts being weighed differently (i.e., having a higher or lower probability of appearing than other pieces) in order to affect the probability of winning puzzle prizes and/or the probability of winning a particular puzzle prize. Although it would be possible to configure the game of FIG. 8 in a fashion similar to that of FIG. 7 (such that any, all or none of the persistent symbols associated with any given reel stop position may be highlighted), in the depicted embodiment, there are always one or two highlighted puzzle parts at any time at each of the nine stops with the selection of active puzzle symbols being made either randomly or toggling in response to events in the slot machine game (such as appearance of predetermined symbols at the reel stop positions 802). When a predetermined result occurs on a given pay line 812*a*, 812*b*, 812*c*, such as a three ball combination 802*d*, 802*e*, 802*f*, all highlighted puzzle pieces on that pay line (which, in the configuration of FIG. 8A is pieces 806*d*, 804*e*, 806*e*, 804*f* and 806*f*) are used to fill in any matching missing pieces from the corresponding puzzles for that line 814*c*, 814*d*. When all pieces of one or more of the puzzles is completed, the prize indicated by the completed puzzle is awarded. In the depicted embodiment, the prize may include, in addition to coins 814*b*, other types of prizes such as food 814*a*, lodging 814*f*, a "mystery" number of coins 814*c* and the like. If desired, the prizes associated with various puzzles, and the configuration of the puzzles, may be changed, e.g., when a puzzle is won, a new player begins playing the game and the like.

Figure 8B:
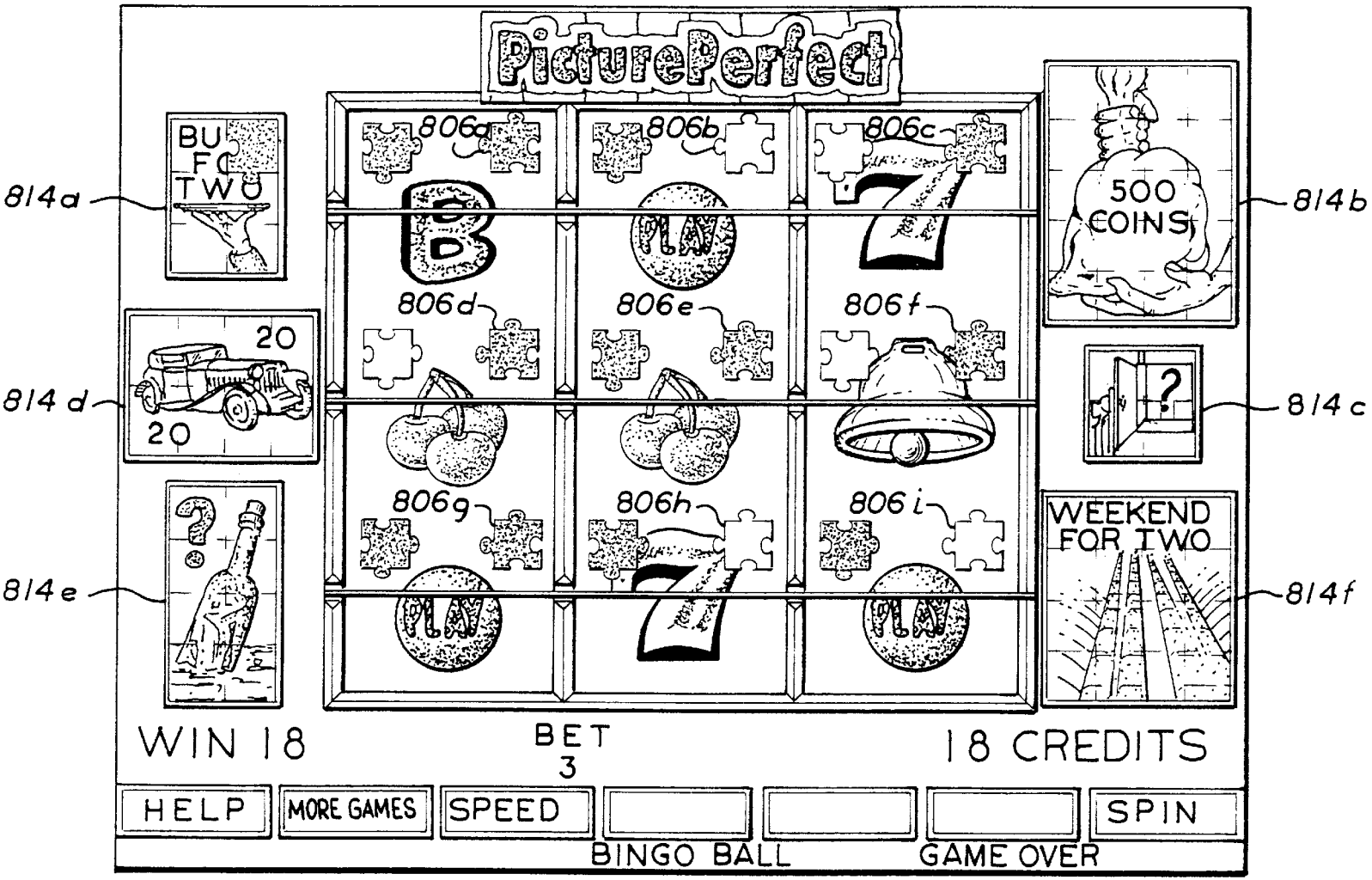

FIG. 8B depicts a screen for an embodiment similar to that of FIG. 8A but in which the puzzle indicia 806*a*–806*i* are located in different areas of the reel stop positions.

In light of the above description, a number of advantages of the present invention can be seen. The present invention is configured to provide game play in such a way as to encourage subsequent play of the game. The present invention dynamically changes the pay out or pay table for the game for subsequent play, and at least some of the events persist over two or more rounds, e.g., until negated by another event. Preferably, the encouragement to subsequent play is provided without substantially changing the fundamental look or feel or nature of the underlying game. The persistent symbols are believed to add to the action or play of the game, but do not, in themselves, occasion a pay out. It is believed that the persistence symbols tend to involve the player in the flow of the game, and encourage subsequent play. The present invention is believed to take advantage of the strengths of a video format and, in particular, lends itself to game animation, adding to interest in the game and entertainment value.

The invention includes the existence of special persistent symbols which, when they achieve (land on) a certain position, leave a persistent effect on that position or on the pay line that position is a member of. In one embodiment, this effect is the promotion or demotion of any symbol which, in subsequent play, lands in that same affected position or in a pay line which includes that position. This promotion or demotion persists until another symbol with a negating effect lands in the same position (or on the pay line, which includes that position), or after the passage of a certain amount of time or subsequent play negates or changes the persistent effect. Preferably, the promotion or demotion is marked by physically altering the look of symbols which occupy the affected position and subsequent rounds of the game, and/or the look and status or the pay line, which is composed of the affected position. According to one embodiment, an important feature is the relationship between the persistent symbol and the position or pay line which includes that position, together with the visible marking of that position or pay line.

A number of variations and modifications of the present invention can also be used. Although a ring symbol hsymbol and a fingerprint symbol have been described for persistent indicators, other indicators can also be used, including other types or shapes of symbols, a change in color and/or highlighting of symbols or background regions, movement, flashing or other time dependent or animation-based indications, and the like. If desired, the present invention can be implemented as part of a network and can be played in combination with or simultaneously with other games such as any of a variety of progressive games 142, 144. It is possible to configure a game such that a persistent symbol once positioned, appears in a plurality of later spins or rounds, but not necessarily in the original location and/or not necessarily with the same effect on game rewards.

Although the invention has been defined by way of a preferred embodiment and certain variations and modifications, other variations and modifications can also be used, the invention being defined by the following claims.

What is claimed is:

1. Apparatus for playing a series of rounds of a first game, comprising:

a computer coupled to a display device configured to display a first game field with a first plurality of symbols for playing said series of rounds of said first game, each of said series of rounds having a win/loss outcome, and wherein said computer outputs, for each of said series of rounds, an indication of the win/loss outcome;

an input device for receiving gaming input from a player and providing said input to said computer;

said computer configured to control said display device to selectively display at least one of a first plurality of indicators, wherein the display of said at least one indicator persists through at least portions of two or more of said series of games;

said computer configured to provide at least a first prize, wherein the award or amount of said first prize is determined at least partially in response to said at least one indicator.

2. Apparatus, as claimed in claim 1 wherein said at least one indicator is displayed in said gamefield.

3. Apparatus, as claimed in claim 1 wherein said at least one indicator is displayed in response to at least a first predetermined event of said first game.

4. Apparatus, as claimed in claim 1 wherein said win/loss outcome is independent of the display of said first plurality of indicators.

5. Apparatus, as claimed in claim 1, wherein said computer is configured to display an indication of the amount of said first prize.

6. Apparatus, as claimed in claim 5 wherein said series of rounds of said first game is associated with at least a second prize, different from said first prize, which is awarded in response to said win/loss outcome.

7. Apparatus, as claimed in claim 1, wherein said first prize is awarded in response to said win/loss outcome and the amount of said first prize is determined at least partially in response to said first indicator.

8. Apparatus for playing a series of rounds of a first game, comprising:

computing means coupled to a display means for displaying a first gamefield with a first plurality of symbols for playing said series of rounds of said first game, each of said series of rounds having a win/loss outcome;

means for outputting, for each of said series of rounds of said first game, an indication of the win/loss outcome;

means for receiving gaming input from a player and providing said input to said computing means;

said computing means configured to control said display device to selectively display at least one of a first plurality of indicators, wherein the display of said at least one indicator persists through at least portions of two or more of said series of rounds of said first game;

said computing means configured to provide at least a first prize, wherein the award or amount of said first prize is determined at least partially in response to said at least one indicator.

9. Apparatus, as claimed in claim 8, further comprising memory means, coupled to said computing means, associated with each of a plurality of positions of said display means, for storing data indicating whether to display one of said plurality of indicators in the associated one of said plurality of positions.

10. Apparatus, as claimed in claim 8, further comprising means for animating said display of at least said first indicator so that said display of said first indicator appears to change or move.

11. A computer-implemented method for playing a series of rounds of a game, comprising:

a) providing a computer coupled to a display, an input device and a wager-acceptor;

b) accepting at least a first wager from a player;

c) playing one of said series of rounds of said game, to provide a game outcome;

d) displaying a first persistent indicator in response to said game outcome;

e) maintaining display of said first persistent indicator through at least two successive rounds of said series of rounds;

f) awarding a prize to said player based at least partially on said first persistent indicator.

* * * * *